United States Patent [19]

Kohno et al.

[11] Patent Number: 4,954,820

[45] Date of Patent: Sep. 4, 1990

[54] TRANSMITTER FOR RADIO CONTROL SYSTEM

[75] Inventors: Naoichi Kohno; Masahiro Arai; Akira Aneha; Michio Fujisaki, all of Mobara, Japan

[73] Assignee: Futaba Denshi Kogyo Kabushiki Kaisha, Mobara, Japan

[21] Appl. No.: 327,611

[22] Filed: Mar. 23, 1989

[30] Foreign Application Priority Data

Mar. 24, 1988 [JP] Japan ..... 63-039447

[51] Int. Cl.[5] ..... H04B 7/00

[52] U.S. Cl. ..... 340/825.69; 340/825.63

[58] Field of Search ..... 340/825.63, 825.69; 341/176, 20; 446/454, 456; 455/91, 92, 95, 97, 99; 273/86 R

[56] References Cited

U.S. PATENT DOCUMENTS

| | | | |
|---|---|---|---|
| 3,246,719 | 8/1962 | Lahr | 446/454 |
| 3,392,485 | 7/1968 | Asano | 446/454 |
| 4,166,338 | 9/1979 | Asano | 446/456 |
| 4,406,085 | 9/1983 | Rhodes | 446/456 |
| 4,508,516 | 4/1985 | D'Andrade et al. | 446/454 |
| 4,604,075 | 8/1986 | Richards et al. | 446/454 |
| 4,617,002 | 10/1986 | Ishimoto et al. | 446/456 |

FOREIGN PATENT DOCUMENTS 59-145996 9/1984 Japan .

*Primary Examiner*—Donald J. Yusko
*Assistant Examiner*—Dervis Magistre
*Attorney, Agent, or Firm*—Oblon, Spivak, McClelland, Maier & Neustadt

[57] ABSTRACT

A transmitter for a radio control system capable of highly facilitating the changing-over operation and constantly exhibiting desired control characteristics. The transmitter includes a plurality of main control elements which are controllable in directions relative to each other about a neutral point and control basic operation of a controlled unit, an auxiliary control element for selecting control characteristics of the main control elements, a first changeover element for changing over mechanically neutral of the main control elements, and a second changeover element operated when specific control characteristics of the main control elements are selected by the auxiliary control element, resulting in setting an electrically neutral point of an actuation section depending on the mechanically neutral point of the main control elements. The operation of the first changeover element causes the second changeover element to be changed over in association therewith.

7 Claims, 6 Drawing Sheets

TRANSMITTER FOR RADIO CONTROL SYSTEM

BACKGROUND OF THE INVENTION

1. Field of the Invention

This invention relates to a transmitter for a radio control system which is adapted to remotely control each of controlled units including various kinds of models such as a model car, a model airplane and the like and a variety of industrial equipments such as a crane and the like, and more particularly to a transmitter for a radio control system exhibiting control characteristics which permit a servo device or the like connected to an actuation section of a controlled unit to exponentially carry out a follow-up actuation when a main control element of the transmitter is controlled in at least one direction about a mechanically neutral point of the main control element or cause the amount of actuation of the servo system about the mechanically neutral point to be in the form of two straight lines different in inclination with respect to the amount of control of the main control element.

2. Description of the Prior Art

In general, remote control of each of controlled units including various models such as a model car, a model airplane and the like and a variety of industrial equipments is carried out using a radio control system. Such a radio control system generally includes a transmitter for transmitting a radio wave depending on the amount of control of a plurality of control elements controlled by a manipulator, a receiver for receiving the radio wave output from the transmitter and an actuation section such as a servo device or the like for controlling a controlled unit depending on an input signal from the receiver.

FIGS. 3A and 3B are a plan view and a rear view showing a transmitter of such a conventional radio control system, the transmitter being adapted to control a model car.

A transmitter generally designated at reference numeral 1 in FIGS. 3A and 3B includes a transmitter body A in which a circuit board for transmission is arranged and a grip section B through which a manipulator holds the transmitter. More particularly, the transmitter body A includes a wheel 2 acting as one of main control elements, which is formed into a cylindrical shape. The wheel 2 is arranged so as to be rotatable in clockwise and counterclockwise directions about its central axis and normally held at its neutral point. Rotation of the wheel 2 in the clockwise or counterclockwise direction causes a steering of a model car which is a controlled unit to be controlled through the receiver and actuation section. The transmitter also includes an antenna 4 arranged on the transmitter body A for discharging an output signal in the form of a radio wave and an auxiliary control element 5 which is constituted by volumes 5*a* and 5*b* and adapted to select control characteristics of the main control elements such as the wheel 2, a trigger lever 3 described hereinafter and the like to improve controllability of the controlled unit.

The grip B includes a trigger lever 3 arranged so as to be pivotally movable about a predetermined position and serve as one of the main control elements. Direct control of the trigger lever 3 for pivotally moving it in the clockwise direction causes the amount of actuation of the servo device or the like to be increased, whereas operation of a return lever 3*a* formed integral with the trigger lever 3 for pivotally moving it in the clockwise direction leads to a decrease in the amount of actuation of the servo device. Thus, operation of the trigger lever 3 and return lever 3*a* causes a speed of a model car which is the controlled unit, its forward movement and its backward movement to be controlled. The grip section B also includes a neutral-point changeover element 6, which is adapted to change over a mechanically neutral point of the trigger lever 3 (a position at which the trigger lever 3 is mechanically held when it is not operated) in several stages, for example, three stages through a link mechanism or the like (not shown) when it is rotated. Thus, the mechanically neutral point of the trigger lever 3 is moved with respect to the total amount of control of the trigger lever 3, so that, for example, the amount of control of the trigger lever 3 is increased when its control in one direction is mainly desired, resulting in accomplishing its finer control.

On a rear surface of the transmitter body A, as shown in FIG. 3(*b*), a changeover switch 5*c*, volumes, switches and the like are arranged.

The auxiliary control element 5, as described above, is adapted to vary control characteristics of the main control element such as the wheel 2, the trigger lever 3 or the like, to thereby improve control characteristics of the controlled unit. A variation in control characteristics of the main control element may be carried out, for example, by means of a reverse mechanism which is adapted to reverse actuation of the servo device or the like loaded on the controlled unit with respect to a control direction of the wheel 2 or trigger lever 3. Alternatively, it may be attained using a mechanism which is adapted to vary the amount of actuation of the servo device about the mechanically neutral point of the wheel 2 or trigger lever 3 depending on its control direction with respect to the amount of control of the wheel 2 or trigger lever 3. In addition, a mechanism may be employed which is constructed so as to control the auxiliary element 5 with respect to the amount of control of the main control element such as the wheel 2, trigger lever 3 or the like in a manner to decrease the amount of actuation of the the servo device near the mechanically neutral point and rapidly exponentially increase it with an increase in the amount of control of the main control element, resulting in the amount of actuation of the servo device obtained at the maximum amount of control of the main control element being similar to that obtained when the auxiliary control element is not controlled (or when actuation characteristics of the servo device are not varied), as shown in FIGS. 4 and 5(*a*) to 5(*c*).

FIG. 4 illustrates an example that relationships between the amount of control of the wheel 2 and the amount of actuation of the servo device are varied depending on control of the auxiliary control element 5. More particularly, the relationships are normally linear as indicated at broken lines. However, operation of the volume 5*a* arranged on the transmitter body A causes the relationships to take an exponential form about the mechanically neutral point of the wheel 2 as indicated at a solid line. In other words, the auxiliary element 5 functions in a manner to cause the amount of actuation of the servo device with respect to the amount of control of the wheel 2 to be decreased near the mechanically neutral point of the wheel 2 and rapidly increased as the amount of control of the main control element approaches its maximum value (its maximum control value in each rotation direction thereof), resulting in the amount of actuation of the servo device obtained at the maximum amount of control of the wheel being similar to that obtained when the volume is not operated. This causes the amount of actuation of a steering of the controlled unit or model car to be decreased near the mechanically neutral point of the wheel 2, resulting in the controlled unit exhibiting excellent controllability such as an improvement in straight advance during its high speed traveling or on a slippery road, the desired maximum amount of actuation of the steering, elimination of effects on cornering and the like.

FIGS. 5(*a*) to 5(*c*) show relationships between the amount of control of the trigger lever 3 and the amount of actuation of the servo device. The relationships are normally linear as indicated at broken lines. Operation of the volume 5*b* arranged on a front surface of the transmitter A and changingover of the changeover switch 5*c* arranged on the rear surface of the body A cause the amount of actuation of the servo device to be exponentially varied as the amount of control of the trigger lever 3 increases exceeding each of reference points determined at positions at which the amounts of control of the trigger lever 3 are 50%, 30% and 0% based on the total amount of control of the trigger lever 3, respectively. Thus, operation or control of the volume 5*b* of the auxiliary control element 5 causes control characteristics of the trigger lever 3 to be varied and the changeover switch 5*c* transfers the reference points at which actuation characteristics of the servo device start to vary with respect to control of the trigger lever 3 as compared with during non-operation of the volume 5*b*.

The following description will be made supposing that each of the reference points at which the actuation characteristics of the servo device (points a, b and c in FIGS. 5(*a*) to 5(*c*)) start to be varied is regarded as an electrically neutral point of the trigger lever 3 for convenience.

Further, operation of the changeover element 6 permits the mechanically neutral point of the trigger lever 3 to be changed over in three stages or among three positions at which the amounts of control of the trigger lever 3 are 50%, 30% and 0% based on the total amount of control of the trigger lever 3, respectively. Operation of the changeover switch 5*c* causes the electrically neutral point of the trigger lever 3 to be moved depending on each of points for the mechanically neutral point of the trigger lever 3.

More particularly, operation or changing-over of the changeover switch 5*c* is carried out so that when the mechanically neutral point of the trigger lever 3 is at the position of 50% based on the total amount of control thereof, the electrically neutral point of the trigger lever 3 is at the position of 50% based on the total amount of control thereof as shown in FIG. 5(*a*) showing the actuation characteristics of the servo device with respect to the trigger lever 3. Likewise, when the mechanically neutral point of the trigger lever 3 is at the positions of 30% and 0% based on the total amount of its control, the electrically neutral point of the trigger lever 3 is changed over to the positions of 30% and 0% by the ch ngeover switch 5*c*, respectively.

When the trigger lever 3 is controlled in a direction of increasing the amount of control of the trigger lever 3 from its mechanically neutral point, the amount of actuation of the servo device with respect to the amount of control of the trigger lever 3 is decreased near the neutral point; whereas as the amount of control of the trigger lever 3 is increased, the amount of actuation of the servo device is exponentially increased, resulting in the desired amount of actuation of the servo device being obtained at the maximum amount of control of the trigger lever 3.

For example, when a speed of the controlled unit or model car is to be controlled by the trigger lever 3, such construction not only causes the speed to be slowly increased with respect to control of the trigger lever 3, resulting in a desired maximum speed of the model car, supposing that the speed is set to be zero at the neutral point of the trigger lever 3 and a direction of increasing the amount of control of the trigger lever 3 is set to be a forward direction, but effectively prevents the model car from slipping on a slippery road, so that controllability of the model car may be highly improved. Also, setting of the mechanically neutral point of the trigger lever 3 when it is mainly desired to control the controlled unit in one direction as in a model car of which only forward movement is mainly desired, setting of the mechanically neutral point of the trigger lever 3 at the position of 30% or 0% based on the total amount of its control permits the controlled unit to be more finely controlled.

The conventional transmitter described above with reference to FIGS. 3(*a*) and 3(*b*) is so constructed that the mechanically neutral point of the trigger lever 3 is selectively changed over in one of the three stages or to one of the three positions by switching or operating the changeover element 6. Also, changing-over of the changeover switch 5*c* arranged on the rear surface of the transmitter body A causes the electrically neutral point of the trigger lever 3 to be changed over depending on the mechanically neutral point of the trigger lever 3.

Thus, in the conventional transmitter, it is required that the mechanically neutral point of the trigger lever 3 is changed over by the changeover element 6, whereas its electrically neutral point is changed over by the changeover switch 5*c*. This results in the changeover operation of the transmitter 1 being highly troublesome as well as the changeover switch 5*c* being often changed over to an incorrect position with respect to the mechanically neutral point of the trigger lever 3.

Changing-over of the changeover switch 5*c* to an incorrect position fails to cause the amount of actuation of the servo device to reach a predetermined level, when the electrically neutral point of the trigger lever 3, as shown in FIGS. 5(*b*) or 5(*c*), is at the position of 30% or 0% based on the total amount of control of the trigger lever 3 in the case that the mechanically neutral point of the trigger lever 3 is at the position of 50% based on the total amount of its control. This results in the amount of actuation of the servo device being suddenly decreased when the volume 5*b* of the auxiliary control element 5 is actuated to change over actuation characteristics of the servo device, to thereby lead to reckless driving or malfunction of the controlled unit or model car. Also, there is a case that the amount of actuation of the servo device at the mechanically neutral point of the trigger lever 3 is not varied depending on the positions for the neutral point of the trigger lever 3, even when the changeover switch 5*c* is changed over to an incorrect position. However, the trigger lever 3 fails to exhibit desired control characteristics because the actuation of the servo device with respect to the amount of control of the trigger level 3 is varied. Such a problem likewise occurs also when the relationships between the amount of control of the trigger lever 3 and the amount of actuation of the servo device about the mechanically neutral point of the trigger lever 3 are indicated at two straight lines different in inclination from each other, in the case that the electrically neutral point is incorrectly set with respect to the mechanically neutral point of the trigger lever 3.

SUMMARY OF THE INVENTION

The present invention has been made in view of the foregoing disadvantage of the prior art.

Accordingly, it is an object of the present invention to provide a transmitter for a radio control system which is capable of permitting a changeover element for changing over a mechanically neutral point of each of main control elements such as a trigger lever and the like and a changeover switch for changing over an electrically neutral point depending on the mechanically neutral point of each of the main control elements to be operated in association with each other to simply and accurately accomplish its changing-over operation.

In accordance with the present invention, a transmitter for a radio control system is provided. The transmitter includes a plurality of main control elements which are controllable in directions relative to each other about a neutral point and control basic operation of a controlled unit and an auxiliary control element for selecting control characteristics of the main control elements. Control of the main control elements and auxiliary control element cause a radio wave to be output from the transmitter and then received as an input signal by a receiver loaded on the controlled unit, resulting in an actuation section being actuated depending on the input signal to carry out remote control of the controlled unit. Also, the transmitter includes a first changeover element for changing over a mechanically neutral of the main control elements and a second changeover element operated when specific control characteristics of the main control elements are selected by the auxiliary control element, resulting in setting an electrically neutral point of the actuation section depending on the mechanically neutral point of the main control elements. The operation of the first changeover element causes the second changeover element to be changed over in association therewith.

In the transmitter of the present invention constructed as described above, changing-over of the mechanically neutral point of each of the main control elements by the first changeover element leads to concurrent actuation of the second changeover element, resulting in the electrically neutral point being changed over depending on the mechanically neutral point of each main control element.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a transmitter for a radio control system according to the present invention will be described hereinafter with reference to the accompanying drawings.

Figure 1:
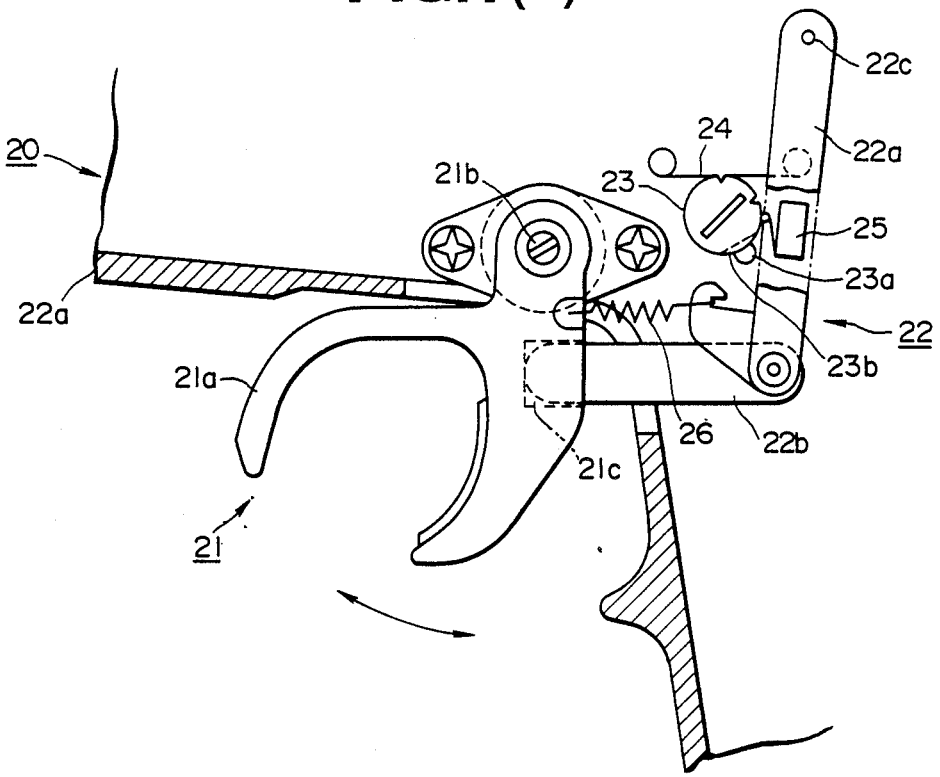
FIGS. 1(*a*), and 1(*b*) are a fragmentary plan view partly in section and a fragmentary side elevation view partly in section each showing an essential part of an embodiment of a transmitter for a radio control system according to the present invention, respectively.
Figure 1:
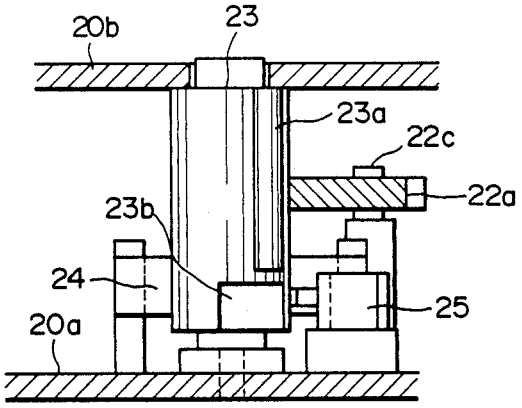

FIGS. 1(*a*) and 1(*b*) show an embodiment of a transmitter for a radio control system according to the present invention. A transmitter of the illustrated embodiment generally designated at reference numeral 20 includes a plurality of main control elements including a trigger lever 21, a wheel (not shown) and the like and arranged on or in outer casings 20*a* and 21*b* and an auxiliary control element for improving controllability of the main control elements. The auxiliary control element includes at least one volume, at least one switch and the like. The auxiliary control element is so constructed that operation of one of such members constituting the auxiliary control element causes the amount of actuation of a servo device to be exponentially varied with respect to the amount of control of the trigger lever 21 within a part or the whole of a control range of the trigger lever 21 or to be varied on two straight lines different in inclination with respect to the amount of control of the trigger lever 21 about its mechanically neutral point.

The trigger lever 21 is mounted on a revolving shaft of a variable resistor fixed on the outer casing 20*a*, so that pivotal movement of the trigger lever 21 permits the variable resistor to be operated. The trigger lever 21 is provided with a return lever 21*a*, which is adapted to be pivotally moved in an opposite direction from the mechanically neutral point of the trigger lever 21.

Now, the manner of changing-over of the mechanically neutral point of the trigger lever 21 will be described.

Reference numeral 22 designates a link mechanism, which comprises arms 22*a* and 22*b* pivotally connected at each one end thereof to one another through a joint section. The arm 22*a* is pivotally mounted at the other end thereof on a shaft 22*c* arranged on the outer casing 20*a* and the arm 22*b* is inserted at the other end thereof into a recess 21*c* formed at the trigger lever 21. The trigger lever 21 and arm 22*a* are forced toward each other by a spring 26 interposedly arranged therebetween, so that normally the arm 22*a* is abutted against a side surface of a control section 23 acting as a first changeover element and the arm 22*b* is abutted at the other end thereof against the trigger lever 21, resulting in the trigger lever 21 being held at its neutral point. The control section 23 is formed on a side surface thereof with a projection 23*a* and a groove 23*b* in parallel with the projection 23*a* in an axial direction of the control section, so that pivotal movement of the control section 23 causes the projection 23*a* to push or force the arm 22*a* to transfer the mechanically neutral point of the trigger lever 21 in a counterclockwise direction in FIG. 1(*a*), resulting in the mechanically neutral point of the trigger lever 21 being changed over in two stages or to two positions. Reference numeral 24 is a notch spring, which is adapted to be engagedly fitted in a groove formed on a side surface of the control section 23 to load pivotal movement of the control section 23, to thereby hold the control section 23 at each position for the mechanically neutral point of the trigger lever 21.

The transmitter 20 of the illustrated embodiment also includes a switch 25 serving as a second changeover element, which is operated to change over an electrically neutral point of the servo device with respect to the amount of control of the trigger lever 21 in two stages depending on the mechanically neutral point of the trigger lever 21. The switch 25 is abutted at its distal end against the side surface of the control section 23, so that it is normally in an operative state. When the control section 23 is pivotally moved, the projection 23*a* forces the arm 22*a*; so that when the neutral point of the trigger lever 21 is changed over, the groove 23*b* of the control section 23 renders the switch 25 non-operative.

Thus, the transmitter of the illustrated embodiment constructed as described above permits changing-over of the mechanically neutral point of the main control element or trigger lever 21 by the first changeover element or control section 23 to concurrently lead to changing-over of the second changeover element or switch 25, so that the electrically neutral point of the servo device may be changed over depending on the positions for the mechanically neutral point of the trigger lever 21.

Accordingly, it will be noted that the transmitter of the illustrated embodiment highly facilitates the changing-over operation, as compared with the conventional transmitter wherein changing-over of the mechanically neutral point of the main control element is carried out separate from that of the electrically neutral point. Also, the transmitter of the illustrated embodiment permits the electrically neutral point of the servo device to be set depending on the mechanically neutral point of the trigger lever 21 concurrently with changing-over of the mechanically neutral point, to thereby eliminate setting of the neutral point at an incorrect position. Also, this leads to changing-over of actuation characteristics of the servo device with respect to control of the trigger lever 21, resulting in the trigger lever 21 exhibiting desired control characteristics.

The remaining part of the embodiment may be constructed in substantially the same manner as the conventional transmitter described above.

The transmitter described above with reference to FIGS. 1(*a*) and 1(*b*) is so constructed that the mechanically neutral point of the trigger lever 21 is changed over in two stages and actuation characteristics of the servo device are correspondingly changed over in two stages. However, the present invention may be constructed so as to vary the mechanically neutral point of the trigger lever and actuation characteristics of the servo device without any stage.

Figure 2:
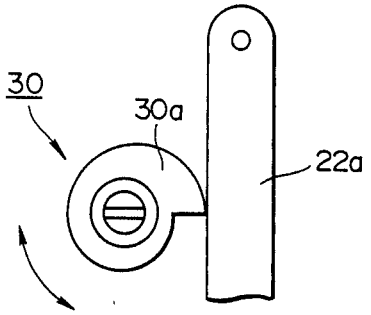
FIGS. 2(*a*) and 2(*b*) are a fragmentary plan view and a fragmentary side elevation view partly in section each showing an essential part of another embodiment of a transmitter for a radio control system according to the present invention, respectively.
Figure 2:
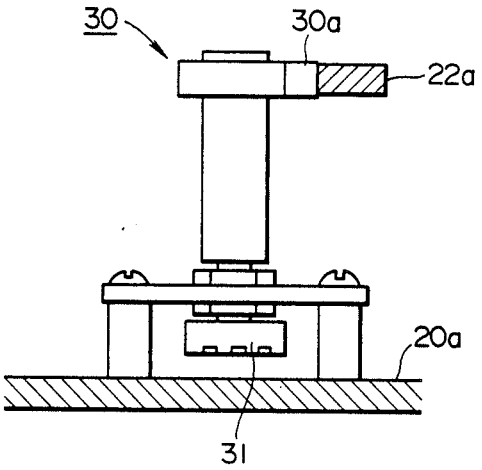
Figure 3:
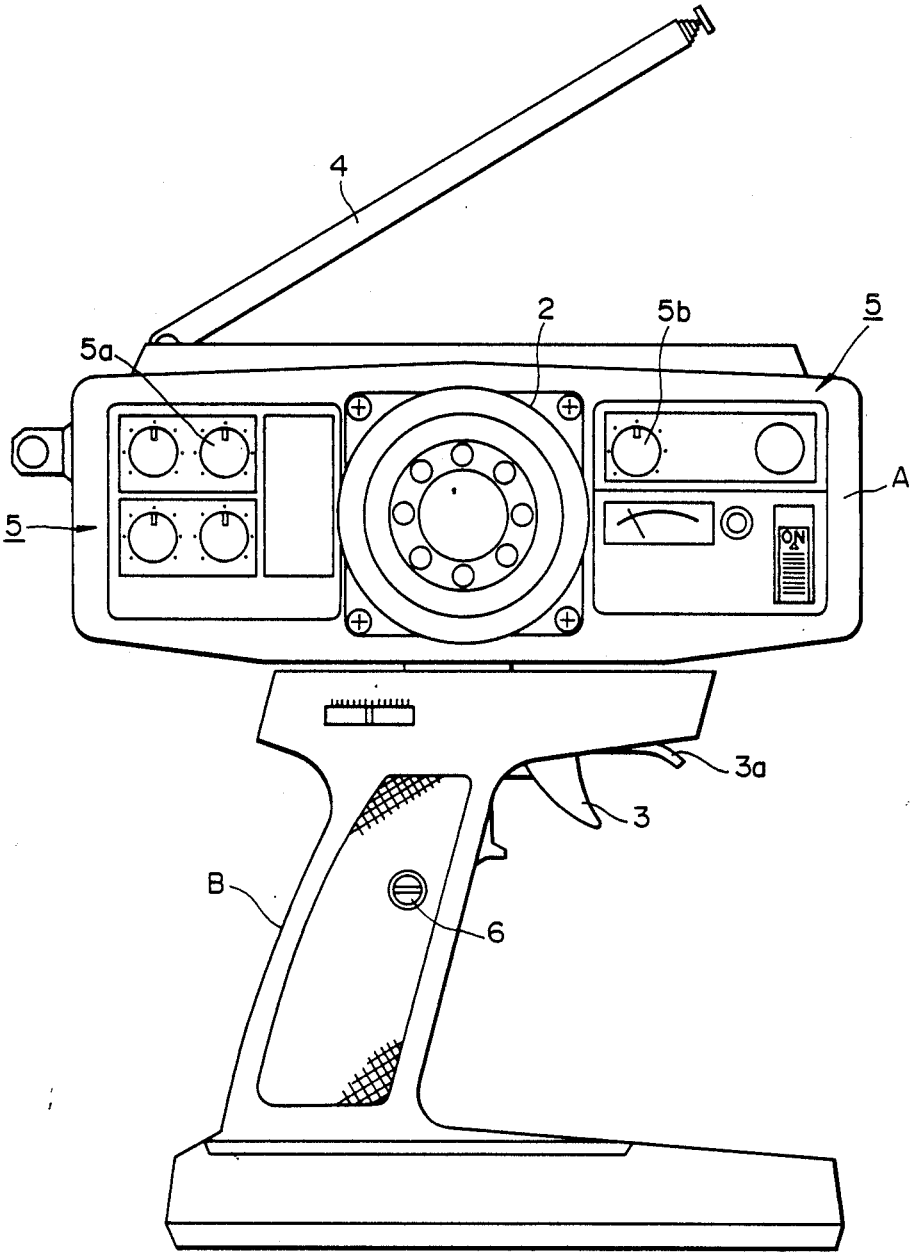
FIG. 3 (a) (PRIOR ART)
FIGS. 3(*a*) and 3(*b*) are a plan view and a rear view each showing a conventional transmitter for a radio control system, respectively.
Figure 3:
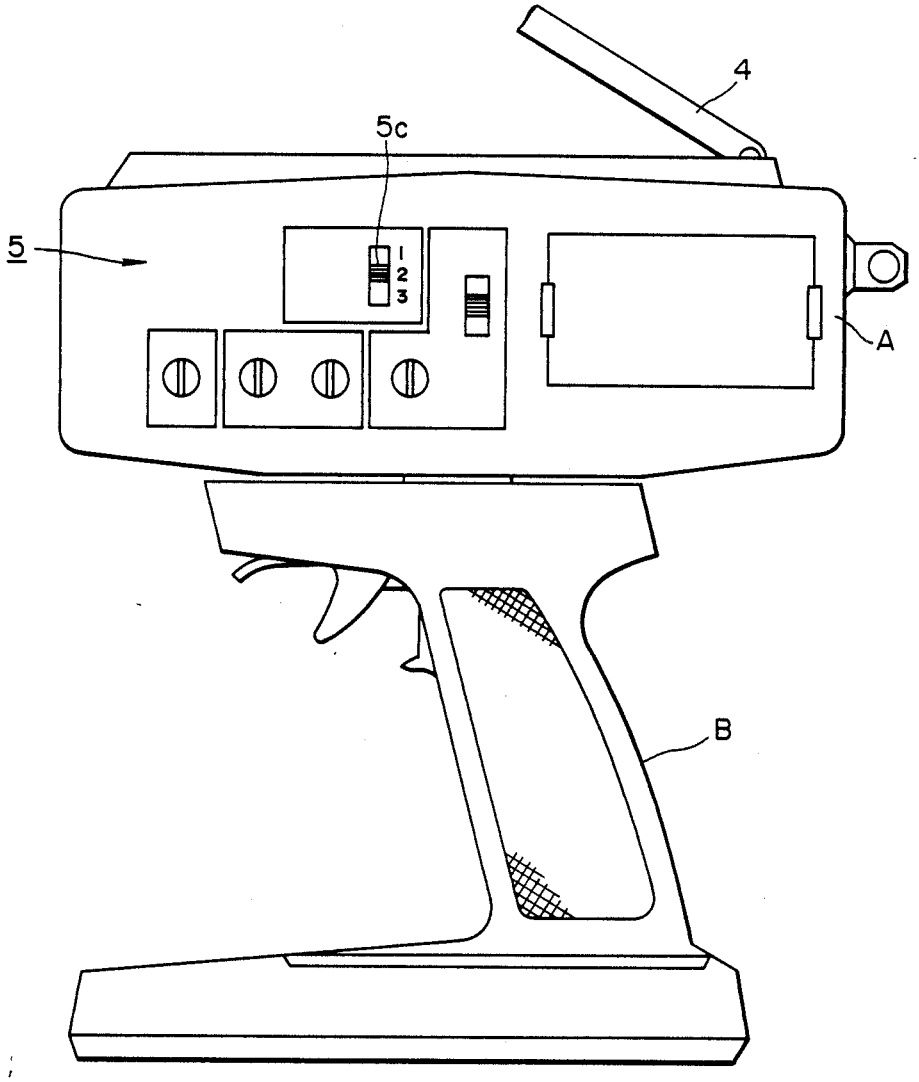
FIG. 3 (b) (PRIOR ART)

FIGS. 2(*a*) and 2(*b*) show another embodiment of a transmitter for a radio control system according to the present invention, which is adapted to vary the mechanically neutral point of the trigger lever and actuation characteristics of the servo device without any stage or in a stageless manner.

A transmitter of the embodiment shown in FIGS. 2(*a*) and 2(*b*) includes a control section 30 serving as a first changeover element, which is provided on its side surface with a helical projection 30*a* having a projecting amount increased in a stageless manner. The control section 30, as shown in FIG. 2(*b*), is integrally mounted at one end thereof on an outer casing 20*a* and connected to a revolving shaft of a variable resistor 31 serving as a second changeover element. Against the projection 30*a* of the control section 30 is abutted an arm 22*a* for determining a mechanically neutral point of a trigger lever 21. Pivotal movement of the arm 22*a* permits the mechanically neutral point of the trigger lever 21 to be changed over in a substantially stageless manner. The variable resistor 31 is operated depending on the amount of control of the control section 30, resulting in its resistance value being varied. A position for an electrically neutral point of the trigger lever 21 is varied depending on a resistance value of the variable resistor 31.

The remaining part of the embodiment shown in FIGS. 2(*a*) and 2(*b*) may be constructed in substantially the same manner as the embodiment described above with reference to FIGS. 1(*a*) and 1(*b*).

In the transmitter of the embodiment of FIGS. 2(*a*) and 2(*b*) constructed as described above, pivotal movement of the control section 30 permits the mechanically neutral point of the trigger lever 21 to be changed over in a substantially stageless manner and the concurrently electrically neutral point to be moved depending on the mechanically neutral point. Accordingly, the embodiment permits changing-over of the mechanically neutral point of the trigger lever and that of the electrically neutral point depending on the mechanically neutral point to be simultaneously accomplished, to thereby facilitate the changing-over operation. Also, it permits the electrically neutral point to be changed over corresponding to the mechanically neutral point of the trigger lever 21 without any malfunction, resulting in desired actuation characteristics of the servo device with respect to control of the trigger lever 21 being exhibited.

In each of the embodiments described above, the transmitter is adapted to control a model car or the like, accordingly, the wheel and trigger lever are arranged for the main control elements. However, two stick levers may be arranged on the transmitter body so as to be substituted for the trigger lever and wheel. In this instance, a changeover element for changing over a mechanically neutral point of each of the stick levers may be used for changing over the electrically neutral point corresponding to the position for the mechanically neutral point.

Figure 4:
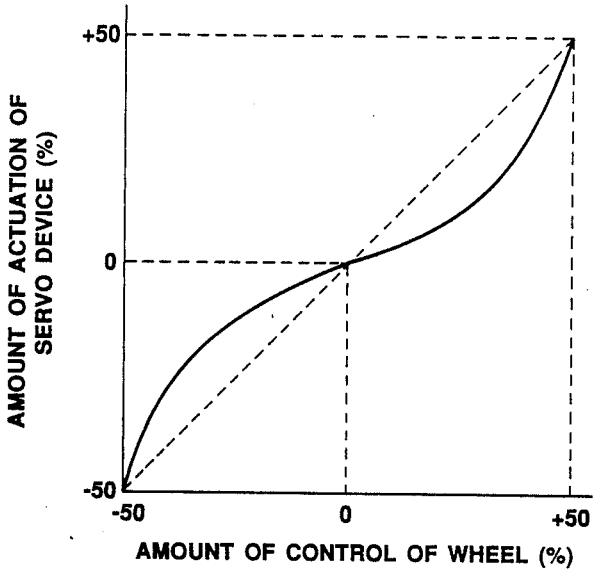
FIGS. 4 and 5(*a*) to 5(*c*) each are a graphical representation showing actuation characteristics of an actuation section such as a servo device or the like with respect to a main control element.
Figure 5:
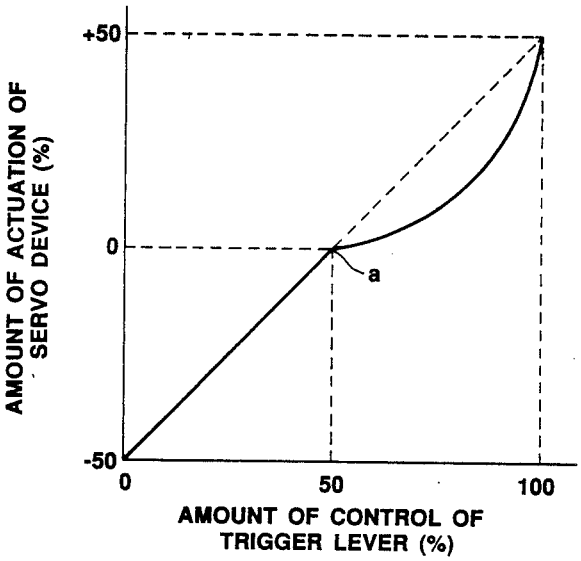
Figure 5:
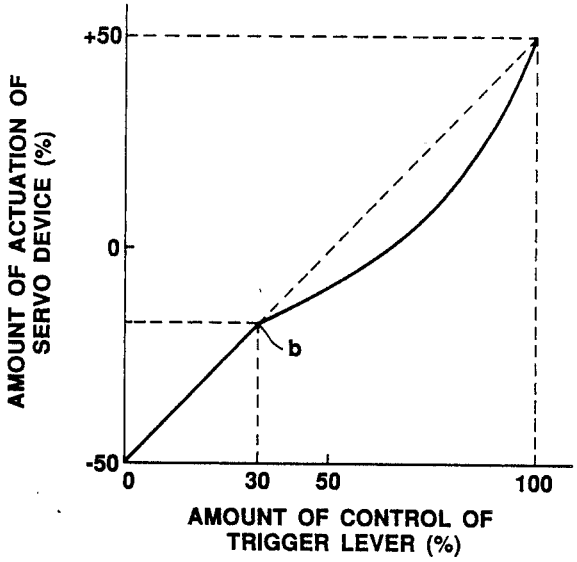
Figure 5:
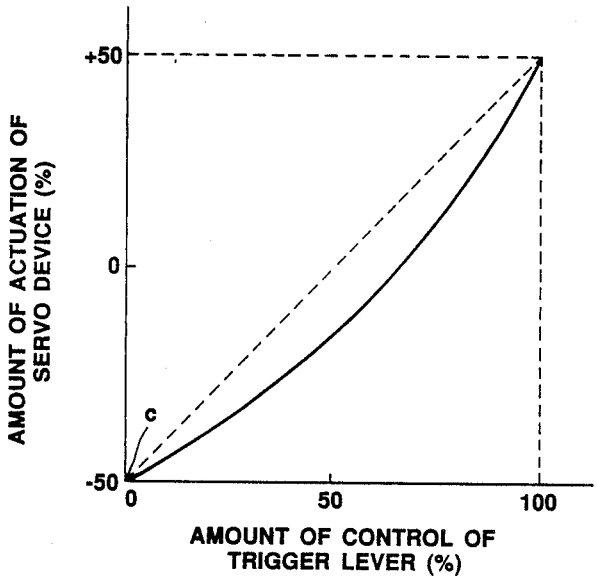

Also, in the embodiments, actuation characteristics of the servo device are varied on an exponential curve in at least one direction based on the electrically neutral point as shown in FIGS. 4 and 5(*a*) to 5(*c*). However, they may be varied in a substantially exponential manner using polygonal lines including at least two straight lines, for example, different in inclination extending in at least one direction. Alternatively, the present invention may be applied to a servo device of actuation characteristics varied on two straight lines different in inclination based on the electrically neutral point.

As can be seen from the foregoing, the transmitter of the present invention includes a plurality of the main control elements which are controllable in directions relative to each other about the neutral point and control basic operation of the controlled unit, the auxiliary control element for selecting control characteristics of the main control elements, the first changeover element for changing over the mechanically neutral of the main control elements, and the second changeover element operated when specific control characteristics of the main control elements are selected by the auxiliary control element, resulting in setting the electrically neutral point of the actuation section depending on the mechanically neutral point of the main control elements, so that operation of the first changeover element causes the second changeover element to be changed over in association therewith.

Thus, in the present invention, operation of the first changeover element permits changing-over of the mechanically neutral point of the main control elements and that of the mechanically neutral point of the actuation section corresponding thereto to be concurrently carried out by a single operation, resulting in the changing-over operation being highly facilitated. Also, the above-described construction of the present invention permits the mechanically neutral point and the electrically neutral point to be changed over at a relationship of 1:1, so that actuation characteristics of the actuation section such as a servo device or the like may be changed over with respect to the main control elements without any error of positions for both neutral points, resulting in the main control elements constantly exhibiting desired control characteristics.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A transmitter for a radio control system comprising:

a plurality of main control elements which are controllable in directions relative to each other about a neutral point and control basic operation of a controlled unit;

an auxiliary control element for selecting control characteristics of said main control elements;

control of said main control elements and auxiliary control element causing a radio wave to be output from said transmitter and then received as an input signal by a receiver loaded on said controlled unit, resulting in an actuation section being actuated depending on said input signal to carry out remote control of said controlled unit;

a first changeover element for changing over a mechanically neutral of said main control elements; and a second changeover element operated when specific control characteristics of said main control elements are selected by said auxiliary control element, resulting in setting an electrically neutral point of said actuation section depending on the mechanically neutral point of said main control elements;

operation of said first changeover element causing said second changeover element to be changed over in association therewith.

2. The transmitter for a radio control system as defined in claim 1, wherein said first changeover element comprises a trigger lever; a link mechanism having arms and pivots for transmitting motion to said trigger lever so as to change over the mechanical neutral point of said trigger lever; a return spring connected to said trigger lever and said link mechanism for biasing said trigger lever; and a means for actuating said link mechanism.

3. The transmitter for a radio control system as defined in claim 2, wherein said link mechanism is biased by a notch spring for holding said means for actuating said link mechanism in a position to have said trigger lever assumed the mechanical neutral points.

4. The transmitter for a radio control system as defined in claim 2, wherein said second changeover element is a switch mounted on said link mechanism to be operated by said means for actuating said link mechanism.

5. The transmitter for a radio control system as defined in claim 2, wherein said means for actuating said link mechanism includes a control section having a projection to push or force said arm of said link mechanism to produce pivotal motion of said arm of said link mechanism and thereby cause said trigger lever to change over the mechanical neutral point.

6. The transmitter for a radio control system as defined in claim 5, wherein said control section is rotatable and said projection projects circumferentially from said control section with a gradually increasing projecting amount, wherein rotation of said control section causes, at a point where said projection pushes against said arm of said link mechanism, stageless increase in the pivotal motion of said arm of said link mechanism and corresponding stageless changeover of the mechanically neutral point.

7. The transmitter for a radio control system as defined in claim 6, wherein said second changeover element is a variable resistor connected to said means for actuating said link mechanism and operated together with said actuating means.

* * * * *